US008448661B2

(12) United States Patent
McDonald

(10) Patent No.: US 8,448,661 B2
(45) Date of Patent: May 28, 2013

(54) INFLATABLE LEAK DIVERTER

(76) Inventor: Christopher McDonald, Manasquan, NJ (US)

( * ) Notice: Subject to any disclaimer, the term of this patent is extended or adjusted under 35 U.S.C. 154(b) by 363 days.

(21) Appl. No.: 12/798,191

(22) Filed: Mar. 31, 2010

(65) Prior Publication Data

US 2011/0240140 A1 Oct. 6, 2011

(51) Int. Cl.
*B67D 1/16* (2006.01)

(52) U.S. Cl.
USPC ..... 137/313

(58) Field of Classification Search
USPC ..... 137/223, 312, 313, 357
See application file for complete search history.

(56) References Cited

U.S. PATENT DOCUMENTS 3,409,917 A * 11/1968 Howard ..... 4/588
3,931,652 A * 1/1976 Navarra ..... 4/588
5,299,591 A * 4/1994 Duncan ..... 137/15.11
5,516,318 A * 5/1996 Saylor ..... 441/40
5,620,018 A * 4/1997 Carpenter et al. ..... 137/312
5,797,994 A * 8/1998 Rasmussen ..... 134/10
5,988,427 A * 11/1999 Moore ..... 220/571
6,622,750 B1 * 9/2003 Bergeron ..... 137/312
7,331,357 B2 2/2008 Huff
7,398,953 B2 * 7/2008 Anderson ..... 251/82
2007/0039650 A1 * 2/2007 Huff ..... 137/312

OTHER PUBLICATIONS

New Pig Corporation; The Big Pigalog (2010 Buying Guide); pp. 271-279; A publication of New Pig Corporation; USA.

* cited by examiner

*Primary Examiner* — John K Fristoe, Jr.
*Assistant Examiner* — Frederick D Soski
(74) *Attorney, Agent, or Firm* — Carl Bilicska

(57) ABSTRACT

An exemplary inflatable leak diverter for collecting falling fluids. The invention may comprise one or more flexible, inflatable, generally tubular, circumferential inflation chambers of substantially identical dimensions superimposed upon each other and fixedly joined along their line of juncture, if applicable; a fluid-collecting well portion of the same general plane shape encompassed within the inner contours of multiple chambers; and drain located approximately in the center of the fluid-collecting well portion.

19 Claims, 8 Drawing Sheets

Figure 1: Prior Art

INFLATABLE LEAK DIVERTER

FIELD OF THE INVENTION

The present invention relates generally to leak diverters and more particularly to inflatable leak diverters that have broad positioning flexibility including areas such as the floor underneath the leak or the functional space between the floor above and structural ceiling.

BACKGROUND

Leak diverters and containers, such as garbage cans and buckets, placed below falling fluids are known and have been used by the construction and building maintenance industries for many years to catch and divert water and to mitigate damage and safety concerns caused by falling fluids. Examples of employed leak diverter designs include: hanging leak diversion devices, tile replacement leak diversion devices and frame-designed above the ceiling leak diversion devices Fluids may include, for example: rainfall, which may pool, causing structural concerns, or seep through damaged roofs; fluids falling from equipment installed in the floor or roof above; or fluids falling from the varied mechanicals installed in the functional hidden space due to, for example: condensation, faulty plumbing or sprinkler systems. Falling fluids may build up within the occupied building space, functional hidden space, walls, roofs and/or other areas and may cause mold, mildew, or other biological growth and/or may cause damage to ceiling tiles, walls, structures and surfaces. Moreover, falling fluids entering the occupied space of the building may cause occupational safety hazards and may cause extensive damage to valuables such as: carpets, furniture, office documents, warehouse storage, and shelved products. Furthermore, the weight of falling fluid pooling on surfaces (e.g. roofs and floors) may compromise the structural integrity of the surface.

There are a number of ceiling installation techniques such as suspended grid ceilings that create a functional hidden space between the underside of the floor above and the structural ceiling. This functional hidden space is often utilized for the installation of mechanicals such as: heating and air condition ducts, sprinkler systems, electrical and communication wiring, gas, plumbing and other pipes, and fire and smoke detectors.

Prior art hanging leak diversion devices, such as shown in FIG. 1, position the leak diverter 100 below the ceiling tile and within the occupied space. A disadvantage of these types of devices is that they require installation to the ceiling and thusly may not be flexibly positioned below the leak, may functionally impact other ceiling installations such as lighting fixtures and may impact on the aesthetics of the occupied space when aesthetics are of concern. Additionally, these devices can not be flexibly positioned above or below the ceiling.

Prior art ceiling tile replacement leak diversion devices, such as disclosed by U.S. Pat. Nos. 5,299,591 and 6,622,750, are designed to replace the ceiling tile within the suspended grid with a custom fitted leak diverter. Though effective at diverting the water and avoiding damage to replaced ceiling tiles, these devices do not usually have the same appearance of the replaced ceiling tile and typically comprise visible hoses which impact the aesthetics of the occupied space. Additionally, these devices can not be flexibly positioned above or below the ceiling as they must be designed to fit within the replaced ceiling tile grid and they create a storage problem for storing the replaced grids.

Prior art leak diversion devices located above the suspended ceiling, such as disclosed by U.S. Pat. No. 7,331,357, are frame designs that are made of solid pre-formed trays that are supported by rigid legs which stand upon the ceiling tiles or support grids. A disadvantage of these devices is that the rigid structure of a frame design creates pressure points on the tile ceiling upon the resting points of the frame structure and are difficult to maneuver through the grid structure and into the functional hidden space and difficult to position about the ceiling tiles (especially when positioning two adjacent leak diverters). Moreover, these devices can not be flexibly positioned above or below the ceiling, are costly, cumbersome to assemble and may take up more storage space when not in use.

Therefore, a need exists for an improved leak diverter.

SUMMARY

The present invention provides an apparatus capable of catching and diverting fluids. More particularly, the present invention provides for an inflatable leak diverter that can be flexibly positioned on any surface or structure below falling fluids, such as, for example: on the floor or a structure below a ceiling; on a roof or other exposed surface; or in the functional space between the floor above and structural ceiling. For the purposes of the present invention, the inflatable leak diverter comprises a portable receptacle for catching and diverting falling fluid. The inflatable leak diverter has a fluid-collecting well portion terminating in a lower drain. Fluid entering the well portion of the inflatable leak diverter is allowed to travel to the lowermost depth of the well due to the inwardly and downwardly sloping floor of the inflatable leak diverter. The fluid is allowed to exit the inflatable leak diverter via the drain. The inflatable leak diverter may be substantially circular, oval, rectangular or virtually any polygonal geometric shape capable of catching fluid.

In a first embodiment, the present invention provides for an inflatable leak diverter. The invention may comprise one or more flexible, inflatable, generally tubular, circumferential inflation chambers of substantially identical dimensions superimposed upon each other and fixedly joined along their line of juncture, if applicable. Also included is a fluid-collecting well portion of the same general plane shape as the inflation chamber that is encompassed within the inner contours of said plurality of chambers, and a drain located approximately in the center of the fluid-collecting well portion.

BRIEF DESCRIPTION OF THE DRAWINGS

The present invention will be better understood from reading the following description of non-limiting embodiments, with reference to the attached drawings, wherein below.

It should be emphasized that the drawings of the instant application are not to scale but are merely schematic representations, and thus are not intended to portray the specific dimensions of the invention, which may be determined by skilled artisans through examination of the disclosure herein.

DETAILED DESCRIPTION

Considerable product efforts have been devoted to manufacturing leak diverters to protect structures from the adverse effects of falling fluids. A most advantageous protection solution requires that a leak diverter not only effectively catch and divert falling fluid, but also allow fast and simple installation, allow installation on varied surfaces and structures, allow fast and simple redeployment to other areas, minimize damage to the existing structure, such as the ceiling tiles, and if desirable, make no impact to the aesthetics of the occupied space. Consequently, a need exists for an improved leak diverter.

The present invention provides an apparatus capable of catching and diverting fluids. More particularly, the present invention provides for an inflatable leak diverter that can be flexibly positioned on any surface or structure below falling fluids, such as, for example: on the floor or a structure below a ceiling; on a roof or other exposed surface; or in the functional space between the floor above and structural ceiling. For the purposes of the present invention, the inflatable leak diverter comprises a portable receptacle for catching and diverting falling fluid. The inflatable leak diverter has a fluid-collecting well portion terminating in a lower drain. Fluid entering the well portion of the inflatable leak diverter is allowed to travel to the lowermost depth of the well due to the inwardly and downwardly sloping floor of the inflatable leak diverter. The fluid is allowed to exit the inflatable leak diverter via the drain. The inflatable leak diverter may be substantially circular, oval, rectangular or virtually any polygonal geometric shape capable of catching fluid.

Figure 1:
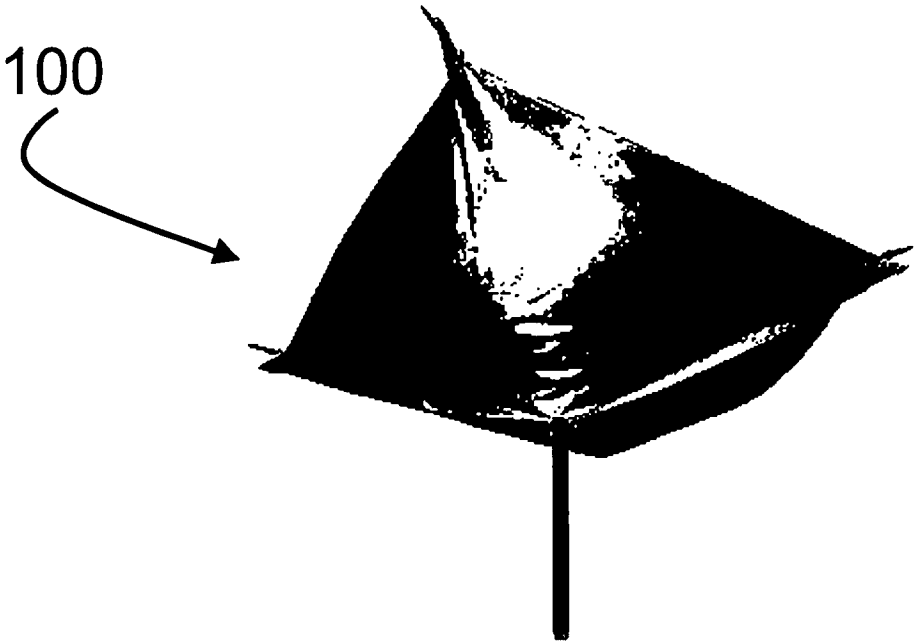
FIG. 1 depicts a prior art hanging leak diverter.
Figure 2:
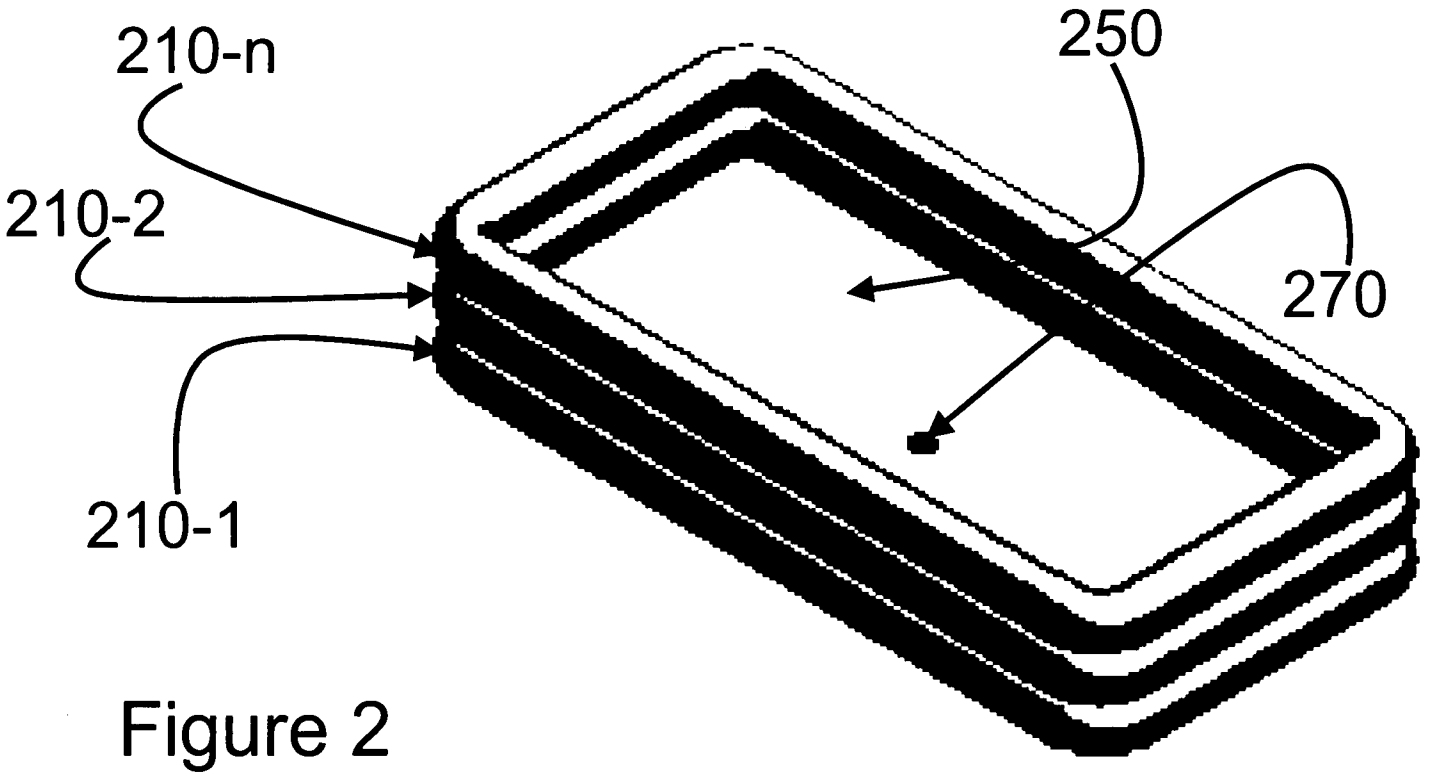
FIG. 2 illustrates an exemplary inflatable leak diverter.

Referring to FIG. 2, an embodiment of the present invention is depicted. Here, an inflatable leak diverter 200 is shown wherein the embodiment shown in FIG. 2 is substantially rectangular. In one exemplary embodiment, the inflatable leak diverter 200 is constructed of a suitable flexible material of a given shape, which is impermeable to air and water. For example, leak diverter 200 may be a rubberized or plastic coated fabric or rigid polyester material which may be deflated and folded up for convenient storage. The substantially rectangular plane shape of inflatable leak diverter 200 as shown is not to be interpreted as limiting the invention to that particular plane shape. The inflatable leak diverter may equally well be of substantially circular, oval, or virtually any polygonal geometric shape or size without affecting the design of the cross-sections illustrated in FIG. 3. Inflatable leak diverter 200 may be sized to fit the standard 24×24 inch or 24×48 inch ceiling panels or may be sized larger or smaller in one or more dimensions of such panels. Moreover, leak diverter 200 may be placed on a surface below the ceiling panels and may be sized larger or smaller or designed to be any plane shape that facilitates installation. For example, larger designs may be preferred in open spaces to minimize the number of leak diverters required.

The inflatable leak diverter 200 may comprise one or more flexible, inflatable, generally tubular, circumferential inflation chambers 210-1 through **210-*n* of substantially identical dimensions superimposed upon each other and fixedly joined along their line of juncture, if applicable; a fluid-collecting well portion 250 of the same general plane shape as the inflation chambers encompassed within the inner contours of the plurality of inflation chambers 210-1 through 210-*n*; and a drain 270** located approximately in the center of the fluid-collecting well portion.

Figure 3:
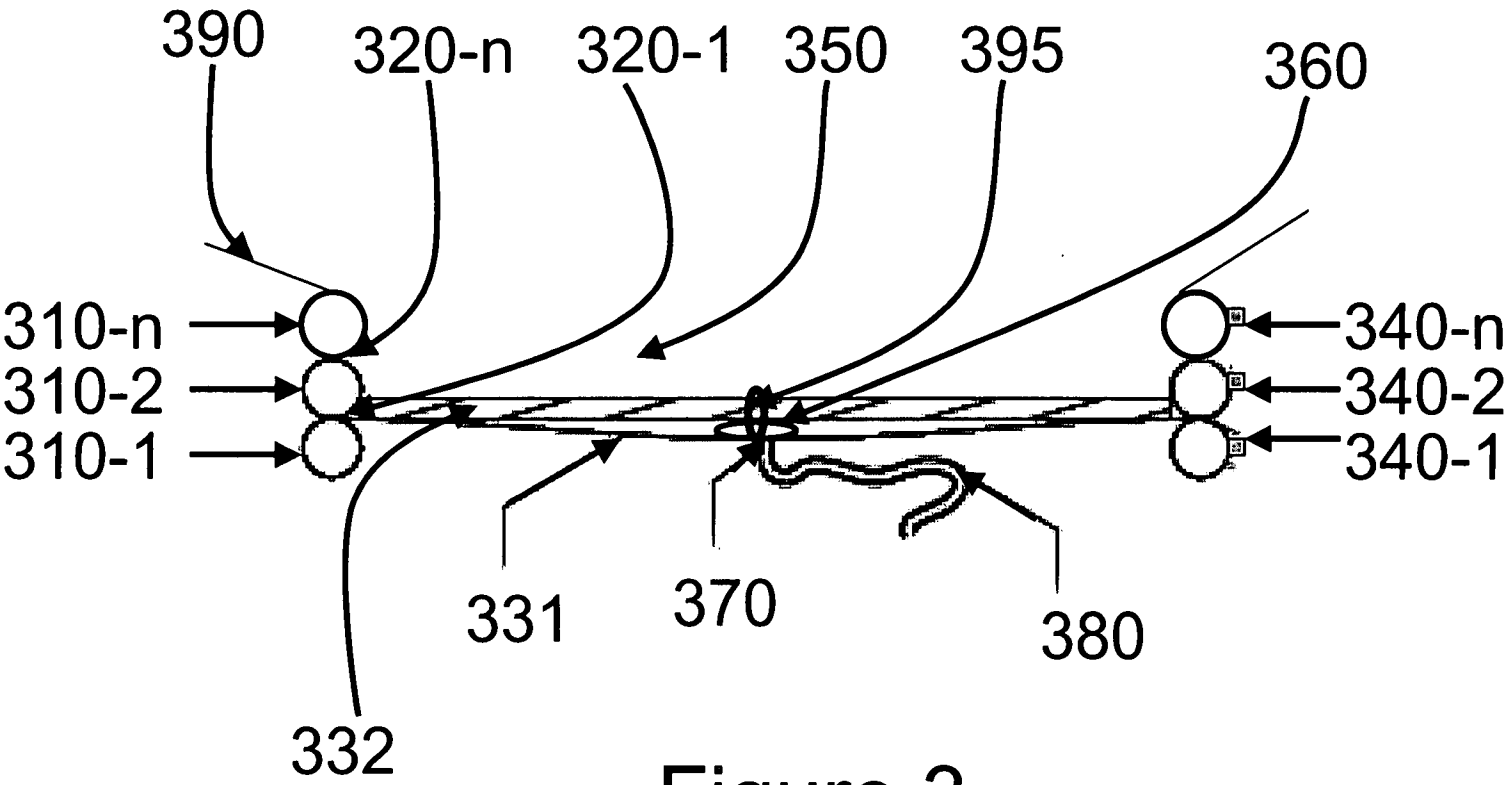
FIG. 3 illustrates a cross section of an exemplary inflatable leak diverter.

Referring to FIG. 3, an embodiment of the present invention detailing the cross section of inflatable leak diverter 200 is illustrated. The inflatable leak diverter 200 comprises one or more inflation chambers 310-1 through **310-*n* that are generally tubular. The chambers may also be of substantially circular, polygonal, or oval shape. Layers of inflation chambers 310-1 through 310-*n* may be of substantially identical dimensions and superimposed upon each other and be fixedly joined along their line of juncture, 320-1 through 320-*n*, if applicable. For example, if only one layer of inflation chambers is utilized, then the single inflation chamber would be joined only with the floor membrane 331 and not other inflation chambers. In one embodiment, inflation chambers 310-1 through 310-*n* may be constructed of a suitable flexible material which is impermeable to air and water, for example a 0.008 inch thick membrane made of rubberized or plastic coated fabric or rigid polyester material. Those skilled in the art may readily recognize that one or more inflation chambers (not shown) may also be fixedly joined below inflation chamber 310-1** to provide, for example, ample space for the fluid retaining well.

The floor membrane 331 may be made of the same material as the inflation chambers 310-1 through **310-*n* and may be joined to one or more inflation chambers 310-1 through 310-*n*. The reservoir base 360 is the substantially level area of the floor membrane 331 that is the low water mark and may be any dimension including zero. In one embodiment, the drain 370 is placed within reservoir base 360 as illustrated, though the drain 370 may be placed anywhere within floor membrane 331. The approximate center of a substantially planar floor membrane 331 may sag due to gravity, as illustrated, to facilitate water flow to reservoir base 360. Those skilled in the art may readily recognize that manufacturing the portion of the floor membrane 331 within the fluid-collecting well portion 350 larger than the area enclosed by inflation chamber 310-1 may allow greater sag in floor membrane 331, creating a larger collecting reservoir and allowing greater flow toward reservoir base 360**.

In one embodiment, the floor membrane 331 may be fixedly joined to one or more inflation chambers 310-1 through **310-*n*. The floor membrane 331 may be fixedly joined along the line of juncture of one or more inflation chambers 310-1 through 310-*n*, as illustrated, or to any portion of the circumference/perimeter of the one or more inflation chambers 310-1 through 310-*n*. Those skilled in the art may readily recognize the varied methods of fixedly joining the floor membrane 331 with one or more inflation chambers 310-1 through 310-*n***, such as for example: welding, stitching, pressing or gluing.

Moreover, those skilled in the art may readily recognize that floor membrane 331 may be constructed from a separate piece of material, as illustrated, or may be formed from the same piece of material as one or more inflation chambers 310-1 through **310-*n*. Additionally, those skilled in the art may readily recognize the additional methods of joining the floor membrane 331 with one or more inflation chambers 310-1 through 310-*n*, such as for example: velco, buttons, snaps, loops, or forming from the same piece of material. Furthermore, those skilled in the art may readily recognize that the volume capacity of the fluid-collecting well portion 350 may be controlled by the design of the area above floor membrane 331 and the area within the inner perimeter of inflation chambers 310-1 through 310-*n***.

Filter material 332 may optionally be positioned within the inner areas of the inflation chambers 310-1 through **310-*n*. Filter material 332 may be made of air filter material such as 0.5 inch thick rigid polyester and may provide splash suppression or sound mitigation of the falling fluids. Filter material 332 may be optionally positioned above or joined to floor membrane 331**.

Those skilled in the art may readily recognize that the thickness of inflation chambers 310-1 through **310-*n*, floor membrane 331 and filter material 332 are not required to be the same thickness dimension and may be any dimension smaller or larger without impacting the utility of the inflatable leak diverter. One would also understand that the material must be rigid enough to provide some stability when inflated to hold fluids accumulating in the fluid-collecting well portion 350** and durable enough to avoid puncturing during ordinary handling.

Figure 3A:
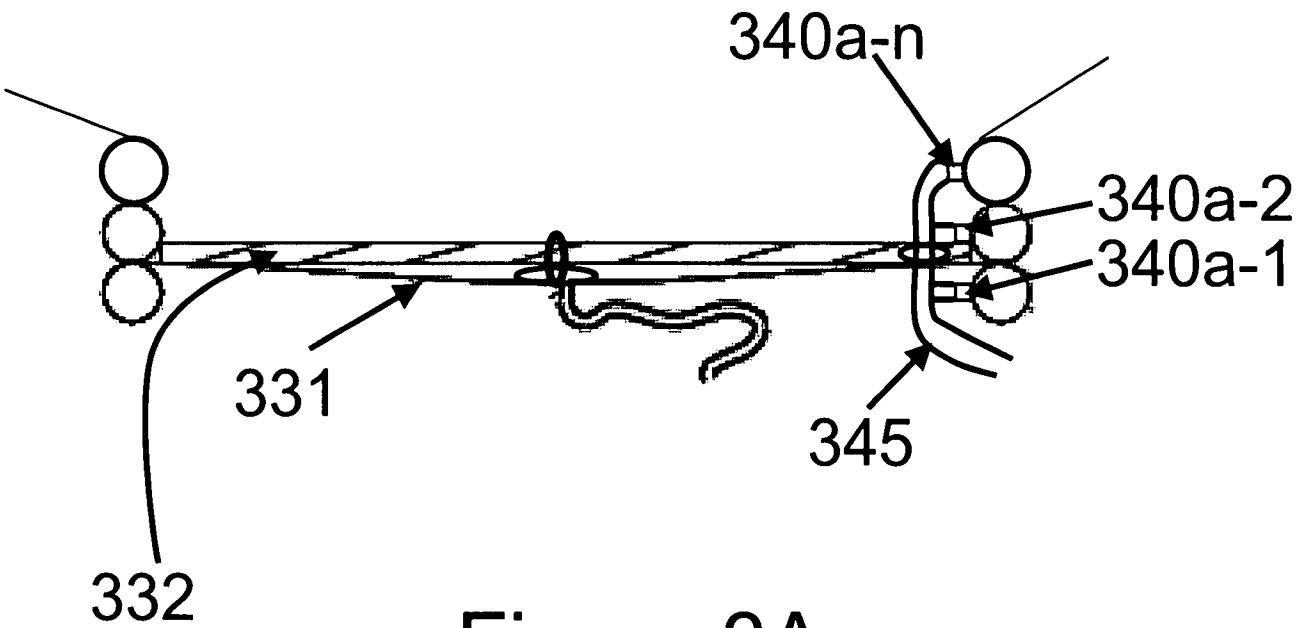
FIG. 3A illustrates a cross section of another exemplary inflatable leak diverter.

As shown in FIG. 3, also included are air valves 340-1 through **340-*n* for inflating inflation chambers 310-1 through 310-*n* . For ease of installation and inflation, air valves 340-1 through 340-*n* may be positioned below the radial center of inflation chambers 310-1 through 310-*n* and/or may be constructed as to substantially recess into inflation chambers 310-1 through 310-*n* when deployed. Such positioning and/or recess advantageously allows two inflatable leak diverters to be positioned side by side or, alternatively, allows an inflatable leak diverter to be positioned contiguous with a wall without air valves 340-1 through 340-*n* impeding the placement. Referring to FIG. 3A, those skilled in the art may readily recognize that air valves 340*a*-1 through 340*a*-*n* may alternatively be placed on the inner half of the inflatable leak diverter, allowing even greater installation ease, by passing air valves 340*a*-2 through 340*a*-*n* through floor membrane 331 and, if applicable, filter material 332. Furthermore, air valves 340*a*-1 through 340*a*-*n* may be joined via a single inflation tube 345** to allow ease of installation.

Still referring to FIG. 3, a strainer member 395 may be placed into the drain 370 to skim off the large potentially clogging debris particles (not shown) and allow the smaller particles (not shown) to pass through the strainer grid (not shown) and exit the drain via the hose. The strainer preferably has spacing suitable for a particular fluid flow, size of drain opening, and degree of filtration level.

Figure 3B:
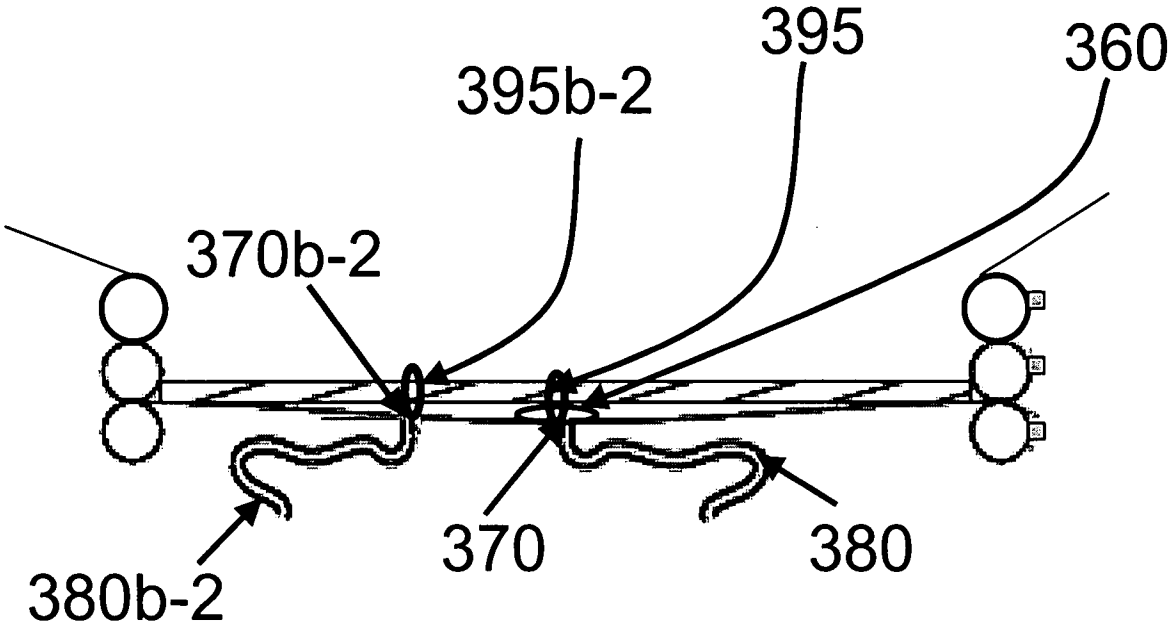
FIG. 3B illustrates a cross section of another exemplary inflatable leak diverter.

The engagement between the drain 370 and the floor membrane 331 may be a tube fitting with barbs welded to floor membrane 331, forming a tubular portion integral within the drain 370. The interior of drain 370 may engage floor membrane 331 from the interior to help prevent the drain 370 from being pulled apart from floor membrane 331 by the weight of the attached flexible hose 380. Moreover, the hose engaging portion of the drain 370 may simply be a tapered or smooth cylindrical portion over which the flexible hose 380 is slipped, making a fitting element unnecessary. The cylindrical portion of the drain 370 may or may not have a retaining collar to expand the inside diameter of the flexible hose 380 in an attempt to resist pull-off from the drain 370. Referring to FIG. 3B, those skilled in the art may readily recognize that one or more additional drains such as **370*b*-2 may complement drain 370 to provide increased draining capacity of collected fluids as well as providing redundancy if drain 370 or attached flexible hose 380 becomes clogged. The one or more additional drains 370*b*-2 may also be positioned outside reservoir base 360 or at a different drainage elevation. Positioning one or more additional drains 370*b*-2 outside reservoir base 360 or at a differing drainage elevation may allow an indication of when fluid is being collected faster than capable of being drained by drain 370 or may allow an indication of when drain 370 or attached flexible hose 380 becomes clogged. Those skilled in the art should realize that one or more additional drains 370*b*-2 may include attendant flexible hose 380*b*-2 and/or strainer 395*b*-2**.

Referring back to FIG. 3, a flexible hose 380 may be attachable to the drain 370 opening. Those skilled in the art may readily recognize that the engagement between the flexible hose 380 and drain 370 may be any other effective coupling method such as a collared threaded fitting.

Joining flap 390, for joining adjacent leak diverters, may be made of the same material as the inflation chambers 310-1 through **310-*n* and may be joined along the inflation chamber 310-*n* circumference. Joining flap 390 is designed to be placed over an adjacent inflatable leak diverter to allow adjacent inflatable leak diverters to be used without falling fluid leaking between the two adjacent inflatable leak diverters. Moreover, joining flap 390** may be attached to a wall to capture falling fluid that is traversing the inner surface of the wall.

Figure 4:
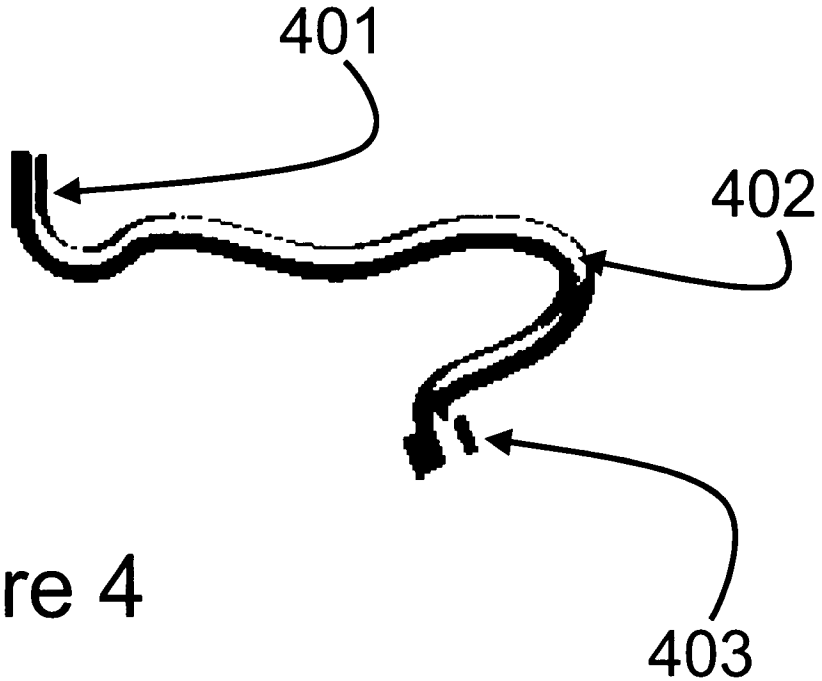
FIG. 4 illustrates an exemplary flexible hose.

Referring to FIG. 3 in combination with FIG. 4, an embodiment of a flexible hose 380 for the invention is illustrated. Flexible hose 380 may be constructed using a clear PVC hose 402 with a drain receiving end 401, designed to attach to the drain 370, and an output end 403. The drain receiving end 401 is constructed to fit over the drain 370 and the output end 403 may be a standard threaded female garden hose fitting designed to mate with a common garden hose.

Figure 5:
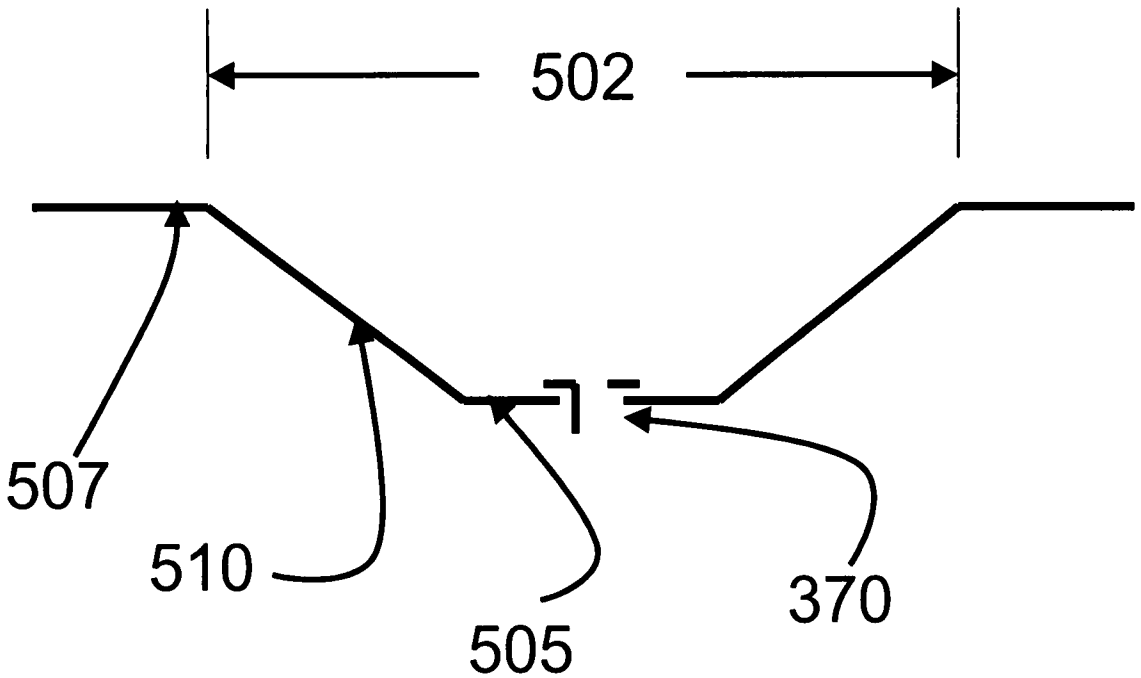
FIG. 5 illustrates an exemplary sloping floor membrane.

Referring to FIG. 3 in combination with FIG. 5, an embodiment of one aspect of the present invention is illustrated detailing a side view of the floor membrane 331 and the drain 370. The floor membrane 331 may be comprised of an attachment lip 507; a sloping wall or side portion 510 and a reservoir base 505. The attachment lip 507 may be constructed to be substantially parallel to facilitate joining the floor membrane 331 along the inflation chamber 310-1 circumference as described above. The floor membrane inner width 502 may be substantially the same as the circumference of the inflation chamber 310-1 to increase the capacity of the fluid-collecting well portion 350. The sloping wall portion 510 may be constructed to slope inwardly to increase the flow of fluids to drain 370 and to increase the capacity of the fluid-collecting well portion 350. Finally, the reservoir base 505 may be constructed to have a radius greater than that of the drain 370 to facilitate placement of the drain and to be substantially parallel to facilitate the engagement between the drain 370 and the floor membrane 331 and to increase the capacity of the fluid-collecting well portion 350.

Those skilled in the art may readily recognize that sloping wall portion 510 does not require a linear slope and may have a varying slope. A varying slope may allow greater flow of collected fluids and increase the capacity of the fluid-collecting well portion 350. Moreover, the inner width 502 and floor membrane and the attachment lip 507 may be sized to fit the standard 24×24 inch or 24×48 inch ceiling panels or may be sized larger or smaller in one or more dimensions of such panels. Furthermore, those skilled in the art may readily recognize that the floor membrane may be designed without the attachment lip 507 and that the inner width 502 of the floor membrane may be or larger or smaller than the inflation chamber 310-1 circumference.

Figure 6:
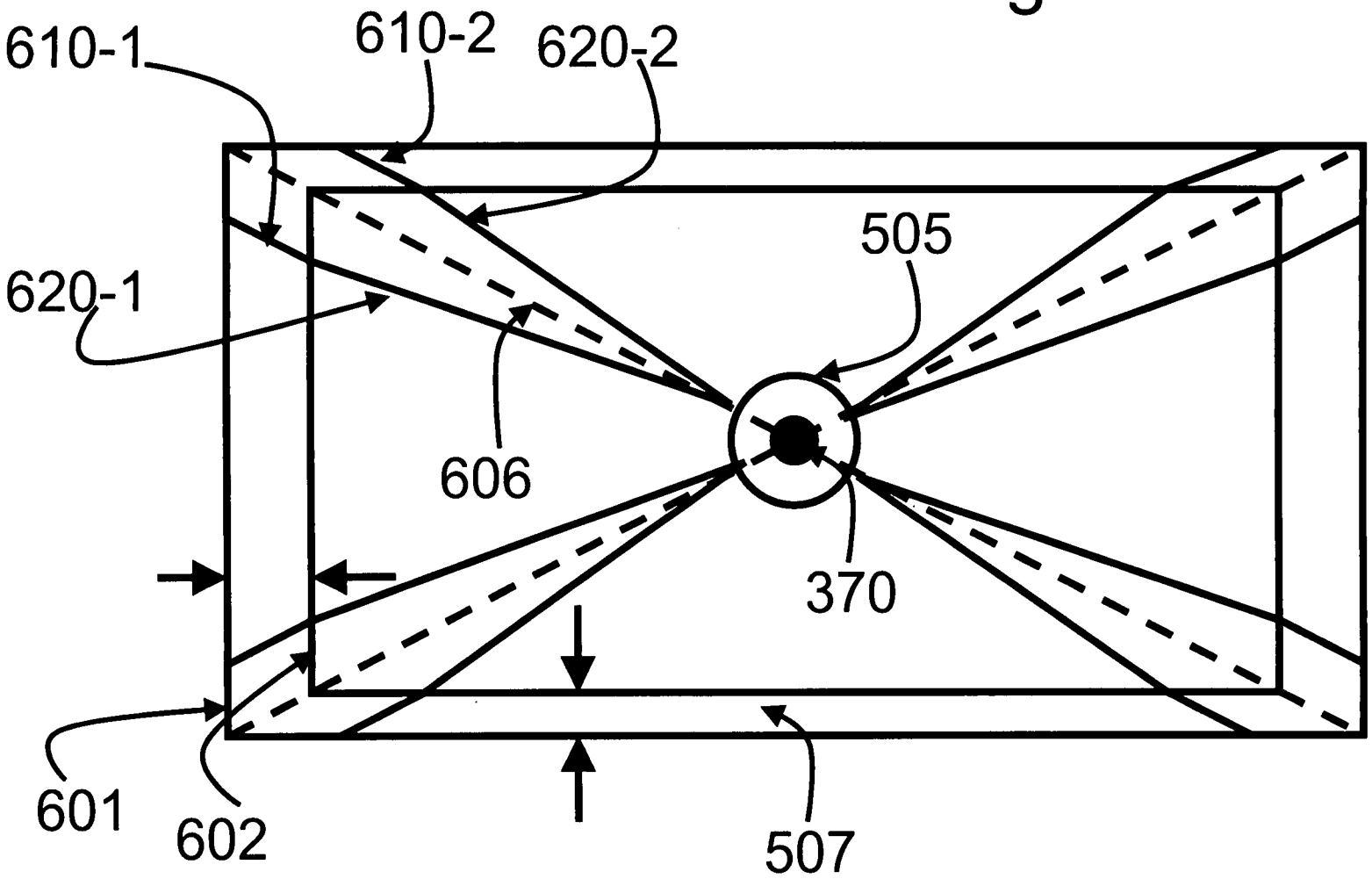
FIG. 6 illustrates an exemplary method of designing an exemplary sloping floor membrane.

Referring to FIG. 6 in combination with FIG. 3 and FIG. 5, a top plan view of the floor membrane 331 illustrates one method of creating the floor membrane 331 shown in FIG. 5. As shown, the generally rectangular floor membrane 331 includes four sets of sloping lines 620-1 through 620-2 originating at the center of the floor membrane in proximity to reservoir base 505 and extending outwardly toward each of the corner regions. Four (dashed) center lines 606 are also shown, where the center lines originate at the core center of the drain 370 and extend outwardly toward the actual corner of the floor membrane.

As shown in FIG. 6, sloping lines extend outwardly from the center of the floor membrane at an angle A with respect to the center line thereby creating two fold regions F in the area between the center line 606 and each of the sloping lines 620-1 and 620-2. By folding the floor membrane and attaching the fold regions up to the sloping lines, an angled well is created that is able to better assist in the directing of leaking fluids into the drain. (See FIG. 5.) As would be understood, by varying the angle of the sloping lines, one can also vary the depth or steepness of the well. Furthermore, it would be understood that sloping lines are not required to begin from reservoir base 505 nor to extend toward each of the corner regions and, in fact, multiple reservoir bases 505 may be made by varying placement of the sloping lines to emanate from a plurality of reservoir bases 505. Furthermore, by constructing additional sloping lines than illustrated in FIG. 6, the shape of the floor membrane 331 may take other shapes and may even approach a smooth conical shape.

Also shown in FIG. 6, four sets of attachment lip lines 610-1 through 610-2 extend substantially parallel to center lines 606, originating from sloping lines 620-1 and 620-2 respectively along inner attachment lip perimeter 602 and extending outwardly to outer attachment lip perimeter 601 creating an attachment lip 507. Although the angled floor membrane is described shown as being made from a single piece of material, it would be understood that a floor membrane as illustrated in FIG. 5 may also be made from various sections wherein the sections are attached during the manufacturing process. Those skilled in the art may readily recognize that sections of floor membrane 331 may be joined in any suitable way such as: glued, stitched, welded, or pressing. Moreover, a floor membrane as illustrated in FIG. 5 may also be made from a single manufactured section with conforming characteristics without modification.

With respect to the embodiments described it would be understood that one inventive aspect of the present invention is the ability of a craftsman to manipulate the inflatable leak diverter into a position. For example, this aspect would be advantageous in manipulating the leak diverter into a confined space between the underside of the floor above and the structural ceiling before inflating the device. As a further example, this aspect would be advantageous in manipulating the leak diverter through stairwells, narrow aisles or other obstacles before placing the device on a surface and inflating the device. As would be understood, this methodology has distinct advantages over transporting rigid structures within such confined areas or areas with limited access.

As described, this aspect may have a number of advantages such as: providing ease in installation; providing advantages in storage requirements; providing advantages in transporting leak diverters from facility to facility; providing advantages in manipulating the leak diverters to their place of installation; and providing the flexibility of installing one leak diverter on any surface below a flow of fluids including: an area within the confined space between the underside of the floor above and the structural ceiling; an area (floor or otherwise) below a ceiling (structural or otherwise); or any other areas including exposed areas such as roofs and patios.

With respect to the embodiments described it would be understood that a second inventive aspect of the present invention is the ability of a craftsman to place the inflatable leak diverter onto an uneven surface, the leak diverter having characteristics allowing the leak diverter to conform to the surface. For example, this aspect would be advantageous in installing the leak diverter on an uneven, sagging surface (e.g. a roof) in order to drain falling fluids to mitigate structural concerns caused by the weight of pooling fluids.

While the particular invention has been described with reference to illustrative embodiments, this description is not meant to be construed in a limiting sense. It is understood that although the present invention has been described, various modifications of the illustrative embodiments, as well as additional embodiments of the invention, will be apparent to one of ordinary skill in the art upon reference to this description without departing from the spirit of the invention, as recited in the claims appended hereto. Those skilled in the art will readily recognize that various other modifications, arrangements and methods can be made to the present invention without strictly following the exemplary applications illustrated and described herein and without departing from the spirit and scope of the present invention. It is therefore contemplated that the appended claims will cover any such modifications or embodiments as fall within the true scope of the invention.

We claim:

1. An inflatable leak diverter for catching and diverting falling fluids comprising:

a first inflation chamber;

a floor membrane joined with the first inflation chamber; and a drain joined through an opening in the floor membrane; and one or more second inflation chambers joined below the first inflation chamber along their respective lines of juncture;

wherein the floor membrane is joined to the first inflation chamber at a join position, the join position being above a low water mark of the floor membrane; and wherein the inflatable leak diverter is configured such that a substantial portion of the floor membrane is above a surface supporting the inflatable leak diverter when the inflatable leak diverter is in an inflated configuration.

2. The inflatable leak diverter of claim 1, further comprising one or more second inflation chambers joined above the first inflation chamber along their respective lines of juncture.

3. The inflatable leak diverter of claim 1, wherein the drain is positioned inside a reservoir base of the floor membrane.

4. The inflatable leak diverter of claim 1, wherein the surface area of the floor membrane defined by the first inflation chamber is larger than a planar area defined by the first inflation chamber.

5. The inflatable leak diverter of claim 1, wherein the floor membrane further comprises a sloping wall portion.

6. The inflatable leak diverter of claim 1, wherein the floor membrane is constructed from the same piece of material as a portion of the first inflation chamber.

7. The inflatable leak diverter of claim 2, further comprising a joining flap joined with at least one of the one or more second inflation chambers.

8. The inflatable leak diverter of claim 2, wherein the first inflation chamber comprises a first air valve positioned within the inner perimeter of the first inflation chamber;

the one or more second inflation chambers comprises a corresponding number of second air valves positioned within the inner perimeter of the one or more second inflation chambers; and the corresponding number of second air valves comprises one or more inflation tubes that pass through the floor membrane.

9. The inflatable leak diverter of claim 3, wherein the drain is a tube fitting with barbs welded to the floor membrane.

10. The inflatable leak diverter of claim 3, further comprising a secondary drain joined to the floor membrane.

11. The inflatable leak diverter of claim 9, further comprising a filter material positioned above the floor membrane.

12. The inflatable leak diverter of claim 11, wherein the filter material is comprised of a rigid polyester material.

13. The inflatable leak diverter of claim 10, wherein the secondary drain is positioned at a higher elevation than the drain.

14. The inflatable leak diverter of claim 5, wherein the floor membrane further comprises an attachment lip portion.

15. An inflatable leak diverter for catching and diverting falling fluids comprising:

a first inflation chamber;

one or more second inflation chambers fixedly joined below the first inflation chamber along their respective lines of juncture;

a floor membrane, including an interior surface area defined by the first inflation chamber that is larger than a planar area defined by the first inflation chamber, fixedly joined with the first inflation chamber along their respective lines of juncture; and a drain joined to the floor membrane;

wherein the inflatable leak diverter is configured such that a substantial portion of the floor membrane is above a surface supporting the inflatable leak diverter when the inflatable leak diverter is in an inflated configuration.

16. The inflatable leak diverter of claim 15, further comprising a secondary drain joined to the floor membrane.

17. The inflatable leak diverter of claim 15, further comprising a joining flap joined with at least one of the one or more second inflation chambers.

18. The inflatable leak diverter of claim 15, wherein the floor membrane further comprises a sloping wall portion and an attachment lip portion.

19. The inflatable leak diverter of claim 16, wherein the secondary drain is positioned at a higher elevation than the drain.

* * * * *